US009033057B2

(12) United States Patent
Sonnier et al.

(10) Patent No.: US 9,033,057 B2
(45) Date of Patent: May 19, 2015

(54) INTERNAL GRIPPING SYSTEM

(75) Inventors: Gareth D. Sonnier, Broussard, LA (US); Stewart Barker, Aberdeen (GB)

(73) Assignee: Baker Hughes Incorporated, Houston, TX (US)

( * ) Notice: Subject to any disclaimer, the term of this patent is extended or adjusted under 35 U.S.C. 154(b) by 145 days.

(21) Appl. No.: 13/425,493

(22) Filed: Mar. 21, 2012

(65) Prior Publication Data

US 2013/0247355 A1 Sep. 26, 2013

(51) Int. Cl.

| | |
|---|---|
| ***E21B 19/10*** | (2006.01) |
| ***E21B 17/046*** | (2006.01) |
| ***E21B 19/16*** | (2006.01) |
| ***E21B 43/08*** | (2006.01) |
| ***E21B 19/07*** | (2006.01) |

(52) U.S. Cl.
CPC ..... *E21B 17/046* (2013.01); *E21B 19/16* (2013.01); *E21B 19/161* (2013.01); *E21B 43/08* (2013.01); *E21B 19/07* (2013.01)

(58) Field of Classification Search
CPC ..... E21B 19/10; E21B 19/161
USPC ..... 166/380, 77.51, 77.52, 77.53, 85.1; 414/908, 910; 294/86.12, 86.25
See application file for complete search history.

(56) References Cited

U.S. PATENT DOCUMENTS

| | | | | |
|---|---|---|---|---|
| 824,530 | A * | 6/1906 | Donaldson | 294/86.14 |
| 1,805,535 | A * | 5/1931 | Vreeland | 294/86.18 |
| 3,664,417 | A * | 5/1972 | Conrad | 166/216 |
| 6,138,529 | A | 10/2000 | Pietras | |
| 6,378,399 | B1 * | 4/2002 | Bangert | 81/57.15 |
| 7,191,686 | B1 | 3/2007 | Angelle et al. | |
| 2004/0216924 | A1 * | 11/2004 | Pietras et al. | 175/57 |
| 2009/0114398 | A1 | 5/2009 | Buytaert et al. | |
| 2011/0000682 | A1 | 1/2011 | Webre et al. | |
| 2011/0247832 | A1 | 10/2011 | Harris | |

OTHER PUBLICATIONS

Baker Hughes, "Completion Assembly Services, Critical preparation services whenever they are needed," Baker Hughes Incorporated, 2010, www.bakerhughes.com, pp. 1-8.

International Search Report and Written Opinion; International Application No. PCT/US2013/026851; International Filing Date: Feb. 20, 2013; Date of Mailing: Jun. 18, 2013; 10 pages.

* cited by examiner

*Primary Examiner* — Cathleen Hutchins
(74) *Attorney, Agent, or Firm* — Cantor Colburn LLP

(57) ABSTRACT

A system for securing a first tubular to a second tubular including a housing having at least one group of at least one window therein. A gripping assembly is disposed in the housing and has at least one member operatively arranged for selectably extending through the at least one window for internally gripping the first tubular. A coupling unit is included having a first clamping mechanism and a second clamping mechanism. The first clamping mechanism is operatively arranged for externally clamping the housing, and the second clamping mechanism is operatively arranged for externally clamping the second tubular component. A method of securing together two tubular components is also included.

12 Claims, 3 Drawing Sheets

INTERNAL GRIPPING SYSTEM

BACKGROUND

Bucking or breakout units are used in the downhole drilling and completions industry for coupling and decoupling threaded connections between tubulars. These units typically having two clamping mechanisms (having hydraulic jaws, tongs, etc.), with each mechanism arranged for holding one of two tubular components to be connected. Generally, at least one of the mechanisms is rotatable relative the other for providing the torque necessary to couple and uncouple the tubular components. However, known bucking units are only able to grip or clamp tubular components exteriorly. This limitation can sometimes be problematic requiring additional effort and cost to overcome. Alternative means to couple and decouple tools are always well received by the art.

SUMMARY

A system for securing a first tubular to a second tubular, including a housing having at least one group of at least one window therein; a gripping assembly disposed in the housing and having at least one member operatively arranged for selectably extending through the at least one window for internally gripping the first tubular; and a coupling unit having a first clamping mechanism and a second clamping mechanism, the first clamping mechanism operatively arranged for externally clamping the housing, and the second clamping mechanism operatively arranged for externally clamping the second tubular component.

A method of securing together a first tubular component and a second tubular component, including clamping a housing having a gripping assembly disposed therein exteriorly with a first clamping mechanism of a coupling unit; clamping the first tubular component exteriorly with a second clamping mechanism of the coupling unit; arranging at least a portion of the housing internally within the second tubular component, the housing having at least one group of at least one window therein; and actuating the gripping assembly for extending at least one member of the gripping assembly through the at least one window for internally gripping the tubular component with the gripping assembly.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
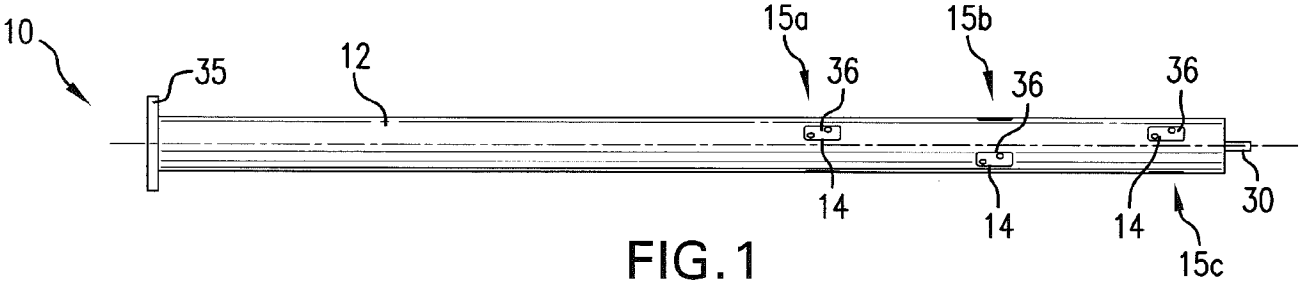
FIG. 1 is a side view of an internal gripping system.
Figure 2:
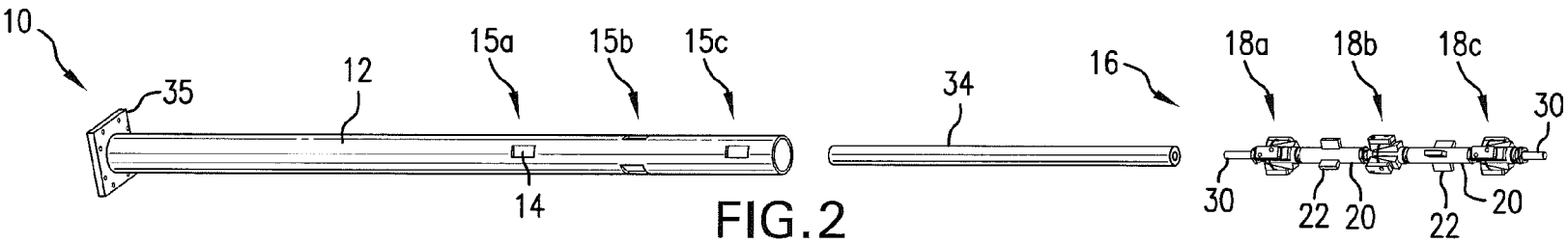
FIG. 2 is an exploded view of the system of FIG. 1.

Referring now to the drawings, an internal gripping system 10 is shown in FIGS. 1-2. The system 10 includes a housing pipe or tubular 12 having a plurality of windows 14 therein. In the illustrated embodiment, the windows 14 are divided into three sets of three windows each, the sets designated with the numerals 15*a*, 15*b*, and 15*c* (collectively the "sets" or "groups 15"). It is to be appreciated that any other number or the sets 15 or of the windows 14 per set could be used in other embodiments. The system 10 also includes a gripping assembly 16 having a plurality of subassemblies 18*a*, 18*b*, and 18*c* (collectively the "subassemblies 18") associated with each set 15*a*, 15*b*, and 15*c*, respectively. A coupler 20 having a plurality of centralizers or stabilizers 22 is located between each adjacent pair of the subassemblies 18 for centering and stabilizing the assembly 16 within the housing 12. Three of the stabilizers 22 are shown extending radially from each of the couplers 20 in the illustrated embodiment, although any other desired number can be included in other embodiments.

Figure 3:
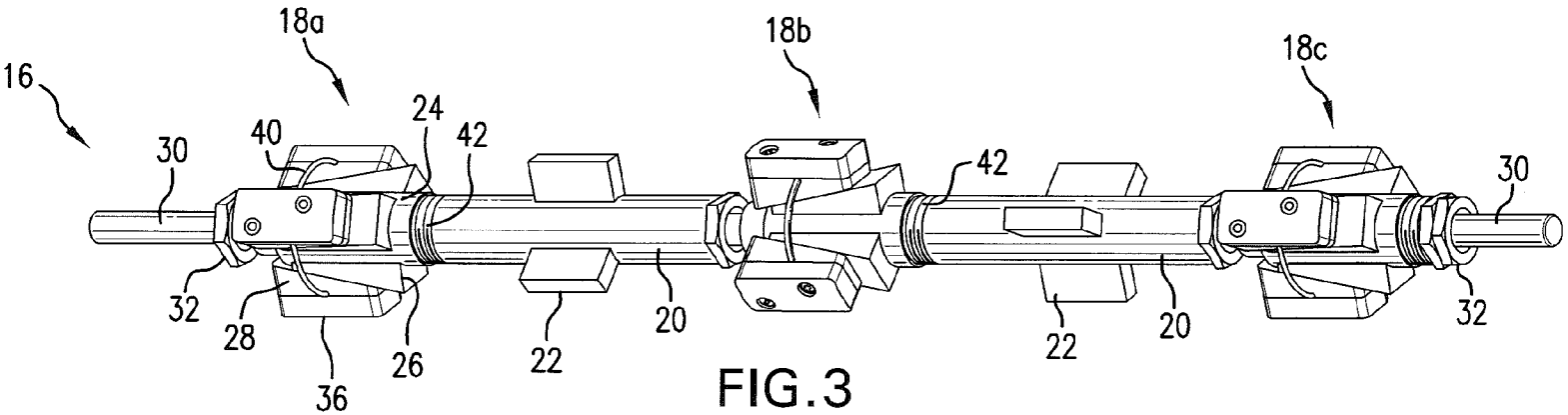
FIG. 3 is a perspective view of a gripping assembly of the system of FIGS. 1 and 2.
Figure 4:
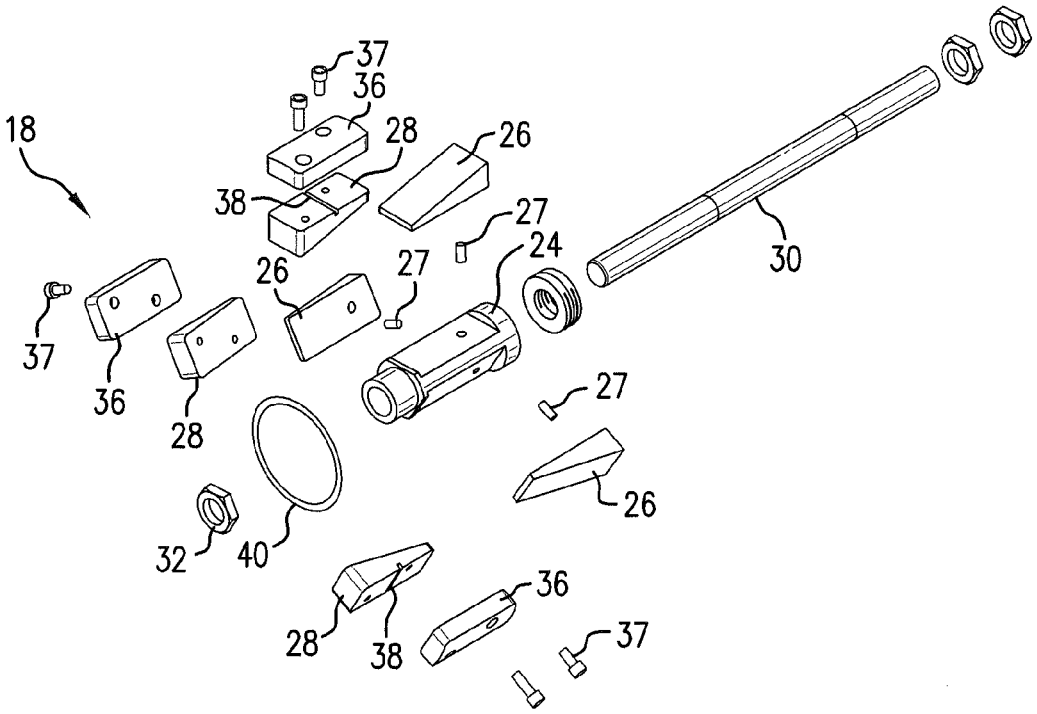
FIG. 4 is an exploded view of a subassembly of the gripping assembly of FIG. 3.
Figure 5:
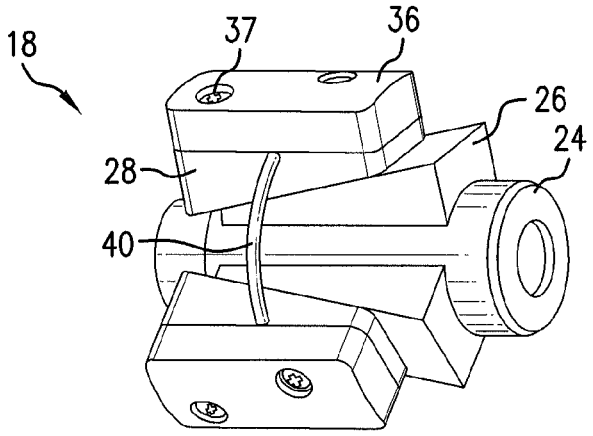
FIG. 5 is a perspective view of the subassembly of FIG. 4.

The gripping assembly 16 and the subassemblies 18 are shown in more detail in FIGS. 3-5. Each of the subassemblies 18 includes a carrier 24 having a number of base wedges 26. The number of the base wedges 26 in each subassembly 18 corresponds to the number of the windows 14 in each of the groups 15 (e.g., in the illustrated embodiment there are three of the base wedges 26 in each of the subassemblies 18 corresponding to the three of the windows 14 in each of the groups 15). In the illustrated embodiment, each of the base wedges 26 is secured to its respective carrier 24 via a pin 27, although the wedges 26 could alternatively be integrally formed with the carrier 18, secured by bolts, adhesives, etc., or combinations thereof.

An extendable wedge 28 is included with each of the base wedges 26 (thereby, the number of the windows 14, the base wedges 26, and the extendable wedges 28 is the same). Each of the windows 14 is provided with one of the extendable wedges 28 positioned therein, with the extendable wedges 28 being selectably extendable/retractable through the windows 14. That is, the base wedges 26 and the extendable wedges 28 could be formed as ramps, wedges, or any other inclined members for translating axial movement of carriers 24 and the base wedges 26 into radial movement of the extendable wedges 28. Specifically, in the illustrated embodiment, the carriers 24 and the base wedges 26 are secured on a shaft 30, e.g., via fasteners such as a plurality of nuts 32. In one embodiment there are multiple shafts and the couplers 20 are at least partially threaded for securing the assembly 16 together, while in other embodiments there is a single shaft spanning the entire length of the assembly 16.

A connecting rod 34 is included in the illustrated embodiment and secured to one of the shafts 30 for connection of the assembly 16 to an actuator (e.g., a hydraulic piston or some other device bolted or secured to a base plate 35 of the housing 12, as discussed in more detail below). The actuator enables actuation of the base wedges 26 in the axial direction via their connection to the carriers 24, which are in turn connected to the actuator via the shaft 30. Relative movement between the wedges 26 and 28, e.g., axial movement of the base wedges 26 toward the extendable wedges 26 results in the wedges 28 being forced to "climb" up the base wedges 26, thereby extending out of their respective windows 14. In this way, the extendable wedges 28 can be radially extended until they encounter a surface of a tubular component to be internally clamped or gripped by the system 10. Continued actuation increases the gripping force exerted by assembly 16. Relative movement can be accomplished by any combination of pulling and/or pushing the wedges 26 and/or the wedges 28 towards each other. To assist in the clamping and/or gripping, each of the extendable wedges 28 may be provided with a die 36, e.g., having properties that enable better gripping, such as coefficient of friction (due to material type or surface texture), hardness, durability, etc. In the illustrated embodiment, the dies 36 are provided as separate components that are secured to the extendable wedges 28 via a plurality of fasteners 37. In another embodiment, the dies 36 could be substituted by a gripping surface on the wedges 28, e.g., formed by a surface treatment or be secured as separate components in some other way.

In the illustrated embodiment, each of the extendable wedges 28 includes a groove 38 for receiving a retaining ring 40. Since the extendable wedges 28 are not secured to the base wedges 26, the retaining ring 40 is included to urge the wedges 28 towards the wedges 26 and maintain the subassemblies 18 in their completed form, thereby preventing, e.g., the extendable wedges 28 from simply falling out of the windows 14. Since the radial position of the extendable wedges 28 changes during actuation of the assembly 16, the retaining ring 40 should be able to stretch and resiliently return to its original shape. In one embodiment the retaining ring is made from nitrile rubber. A plurality of spring elements 42, e.g., disc springs or the like, may be included, e.g., between each of the subassemblies 18, for pre-tensioning the carriers 24, and therefore the base wedges 26, toward the extendable wedges 28 and assisting the retaining ring 40 in maintaining the assembly 16 in its completed form.

Figure 6:
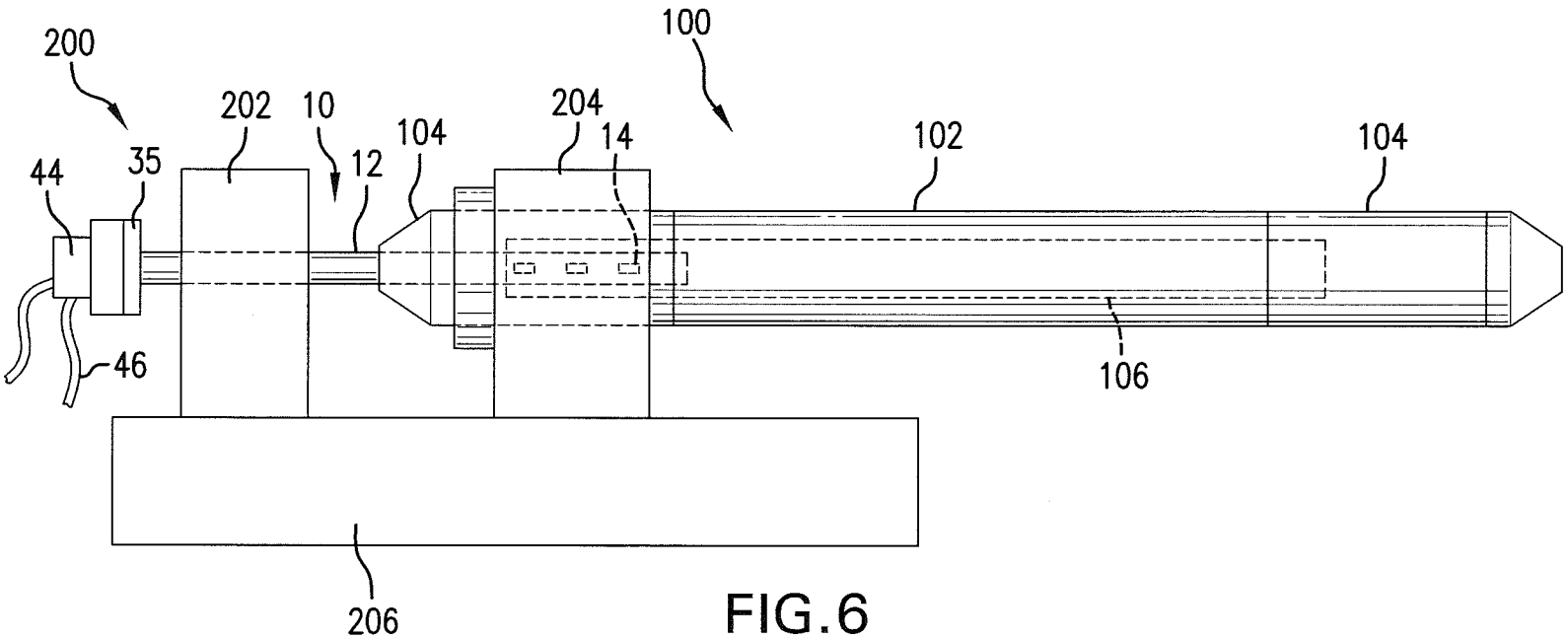
FIG. 6 is schematically illustrates the system of FIG. 1 being used with a bucking unit to internally grip a pipe for assembling a tubular device.

The operation of the system 10 can be better appreciated in view of the example embodiment illustrated in FIG. 6. FIG. 6 depicts a tubular device 100 having a screen 102 disposed between a pair of flow caps 104. The flow caps 104 are threaded or otherwise arranged for connection to other tubulars, e.g., for forming a tubular string. Internally within the screen 102 is a pipe 106 for enabling the passage of fluids therethrough, e.g., downhole fluids filtered by the screen 102 during production. The pipe 106 is arranged extending between the caps 104 and secured thereto, e.g. by a threaded connection. A coupling unit 200 is also illustrated in FIG. 6. The coupling unit 200 generally resembles a known bucking or breakout unit, including a first jaw, tong, or external clamping mechanism 202 and a second jaw, tong, or external clamping mechanism 204. At least one of the mechanisms 202 or 204 may be movable along a track 206 for facilitating the arrangement of tubular component in the coupling unit 200. Additionally, at least one of the mechanisms 202 or 204 is able to rotate for enabling torqueing/untorqueing operations (e.g., threadedly connecting/disconnecting the tubular components).

As the coupling unit 200 resembles known bucking or breakout units, the jaw mechanisms 202 and 204 are only capable of gripping the exterior surfaces of tubular components. Due to the particular configuration of the tubular device 100, it is not feasible to exteriorly grip the pipe 106 for threaded connection with the end caps 104, and therefore the tubular device 100 can not be assembled by the coupling unit 200 alone. Advantageously, the system 10 enables a typical bucking unit, e.g., the unit 200, that grips exteriorly only, to be used to internally grip components, e.g., such that an exteriorly gripped component and an internally gripped component can be secured together. Specifically, the system 10 is arranged such that one of the jaws of the coupling unit 200, i.e., the mechanism 202 in the illustrated embodiment, grips an exterior of the housing 12 while the other jaw, i.e. the mechanism 204 in the illustrated embodiment, grips an exterior tubular component of the tubular device 100, i.e., the cap 104 in the illustrated embodiment. The housing 12 is inserted into the interior component of the assembly 100, i.e., the pipe 106 in the illustrated embodiment, so that the windows 14 and therefore the gripping assembly 16 and the subassemblies 18 are within the pipe 106. The subassemblies 18 are actuated, e.g., by axially moving the base wedges 26 toward the extendable wedges 28 as described above. For example, the connecting rod 34 may be secured between the assembly 16 and an actuator 44 that is secured, e.g., bolted, to the plate 35 of the system 10. In one embodiment the actuator 44 is a piston operated by fluid pressure, e.g., a hydraulic cylinder, that is fed by a fluid pressure line 46. For example, in one embodiment, the fluid pressure line 46 is tied into the hydraulics that power the jaw mechanisms 202 and 204 of the coupling unit 200. It is to be appreciated that actuation of the assembly 16 could be provided by any suitable device, such as a lead screw, motor, piston, etc., and powered by electrical, mechanical, hydraulic, pneumatic, magnetic, or any other source. In this way, the actuator 44 can actuate the assembly 16 and/or the subassemblies 18 in order to move the base wedges 26 toward the extendable wedges 28, causing the extendable wedges 28 to extend radially outwardly through the windows 14 for gripping an interior surface of the pipe 106. Once the pipe 106 is interiorly gripped by the system 10, rotation of at least one of the mechanisms 202 and/or 204 enables the pipe 106 to be threadedly secured to the cap 104, despite the coupling unit 200 only being arranged to grip exterior surfaces.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A system for securing a first tubular to a second tubular, comprising:

a housing having at least one group of at least one window therein;

a gripping assembly disposed in the housing and having at least one member operatively arranged for selectably extending through the at least one window for internally gripping the first tubular; and a coupling unit having a first clamping mechanism and a second clamping mechanism, the first clamping mechanism operatively arranged for externally clamping the housing, and the second clamping mechanism operatively arranged for externally clamping the second tubular, the coupling unit being configured and disposed to secure the first tubular to the second tubular.

2. The system of claim 1, further comprising a subassembly associated with each group of at least one window, each subassembly having a first wedge and a second wedge together associated with each window, each first wedge being disposed in a corresponding one of the at least one window and operatively arranged with the second wedge to be selectably extendable through the corresponding window due to relative movement between the first and second wedges.

3. The system of claim 2, wherein there are a plurality of windows in each group of at least one window and a corresponding plurality of sets of first and second wedges associated therewith.

4. The system of claim 3, wherein the at least one window comprises three windows in each group, the gripping assembly having three sets of first and second wedges, with one set associated with each of the three windows.

5. The system of claim 3, wherein a retaining ring is disposed for maintaining engagement of the first wedges against corresponding ones of the second wedges.

6. The system of claim 5, wherein the retaining ring is resiliently expandable for permitting the first wedges to extend from the windows.

7. The system of claim 2, further comprising an actuator for enabling relative movement between the first and second wedges.

8. The system of claim 7, wherein the actuator is operated via fluid pressure.

9. The system of claim 8, wherein the fluid pressure is provided by the coupling unit.

10. The system of claim 1, wherein the at least one group comprises a plurality of groups of at least one window.

11. The system of claim 10, wherein the plurality of groups comprises three groups of at least one window and the at least one subassembly comprises three subassemblies associated therewith.

12. The system of claim 10, wherein the gripping assembly includes a coupler disposed between each adjacent pair of the subassemblies, the coupler having at least one stabilizer thereon for stabilizing the gripping assembly in the housing.

* * * * *